US006193087B1

(12) United States Patent
Gunnarsson et al.

(10) Patent No.: US 6,193,087 B1
(45) Date of Patent: Feb. 27, 2001

(54) TWO ARMS SYSTEM

(75) Inventors: Wiking Gunnarsson, Dalslanged; Karl Gustav Lindqvist, Ed, both of (SE)

(73) Assignee: Motrac AB, Ed (SE)

( * ) Notice: Subject to any disclaimer, the term of this patent is extended or adjusted under 35 U.S.C. 154(b) by 0 days.

(21) Appl. No.: 09/269,162

(22) PCT Filed: Sep. 23, 1996

(86) PCT No.: PCT/SE96/01186

§ 371 Date: May 5, 1999

§ 102(e) Date: May 5, 1999

(87) PCT Pub. No.: WO98/12138

PCT Pub. Date: Mar. 26, 1998

(51) Int. Cl.[7] ..... B66C 23/68
(52) U.S. Cl. ..... 212/300; 212/232; 212/238
(58) Field of Search ..... 212/238, 261, 212/300, 232

(56) References Cited

U.S. PATENT DOCUMENTS 3,828,939 * 8/1974 Tranchero ..... 212/300
4,770,271 * 9/1988 Tranchero ..... 212/261
5,197,615 * 3/1993 Gunnarson ..... 212/300
5,507,107 * 4/1996 Pinomake ..... 212/300

FOREIGN PATENT DOCUMENTS 2508872 9/1976 (DE) .
318382 12/1969 (SE) .
382039 1/1976 (SE) .
7411568 4/1976 (SE) .
8603660 4/1988 (SE) .
463668 1/1991 (SE) .
93/00286 1/1993 (WO) .

* cited by examiner

*Primary Examiner*—Thomas J. Brahan
(74) *Attorney, Agent, or Firm*—Dennison, Scheiner, Schultz & Wakeman

(57) ABSTRACT

Unit cranes consist of three jointed arms (13–15), the middle arm (14) being in the form of a polygon comprising a number of units jointed together, the mobility of the units being arranged by influencing the units internally. The object of the invention is to achieve improved traction curves and speed curves, and this is effected by influencing the movement of the units from the outside by means of a hydraulic mechanism.

15 Claims, 6 Drawing Sheets

Figure 1:
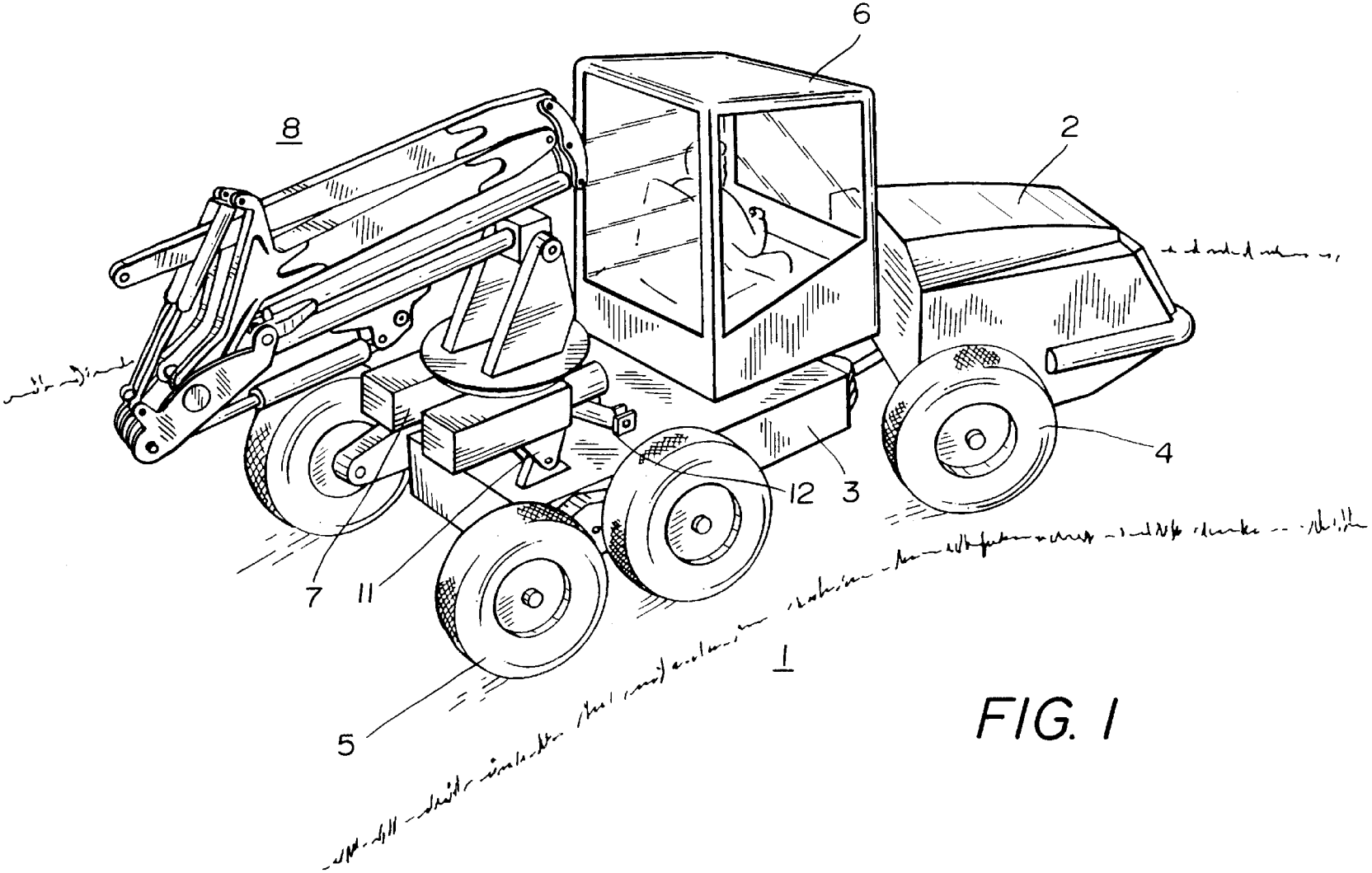

FIG. 4
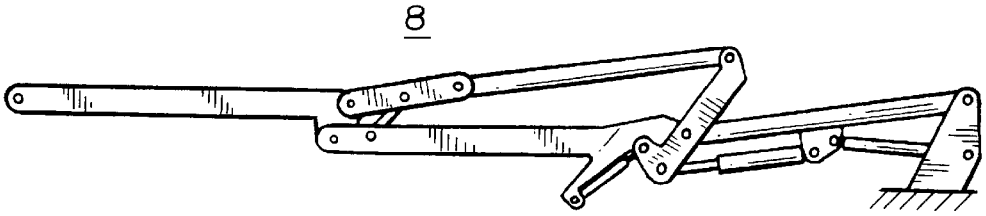
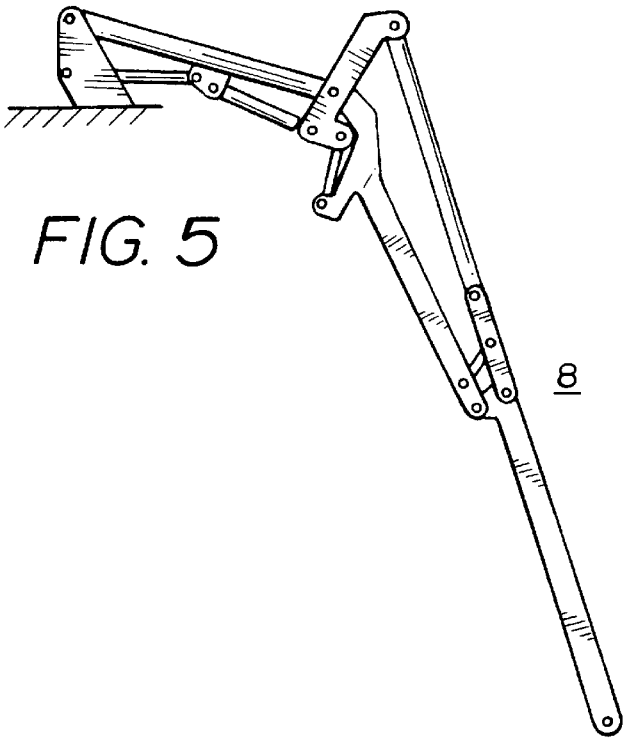
FIG. 5
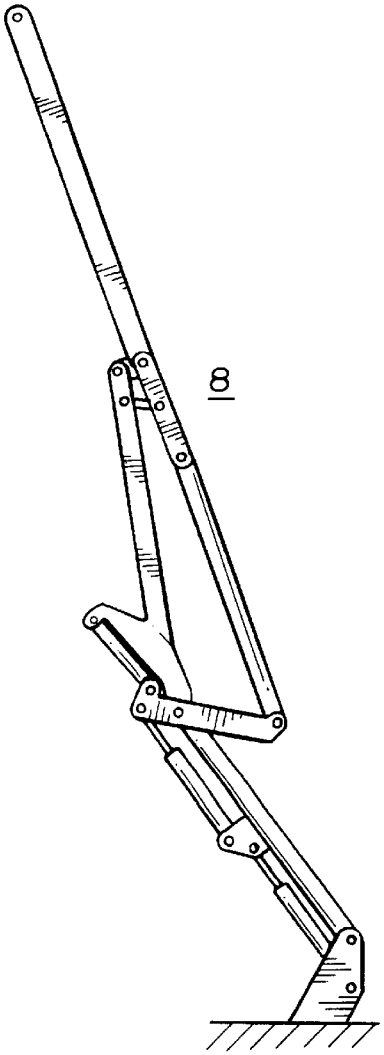
FIG. 6

FIG. 8
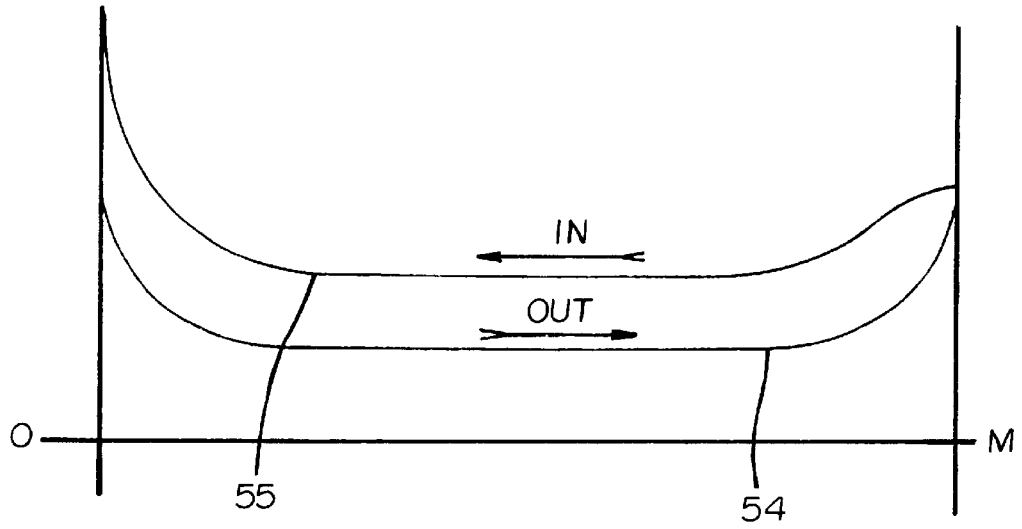
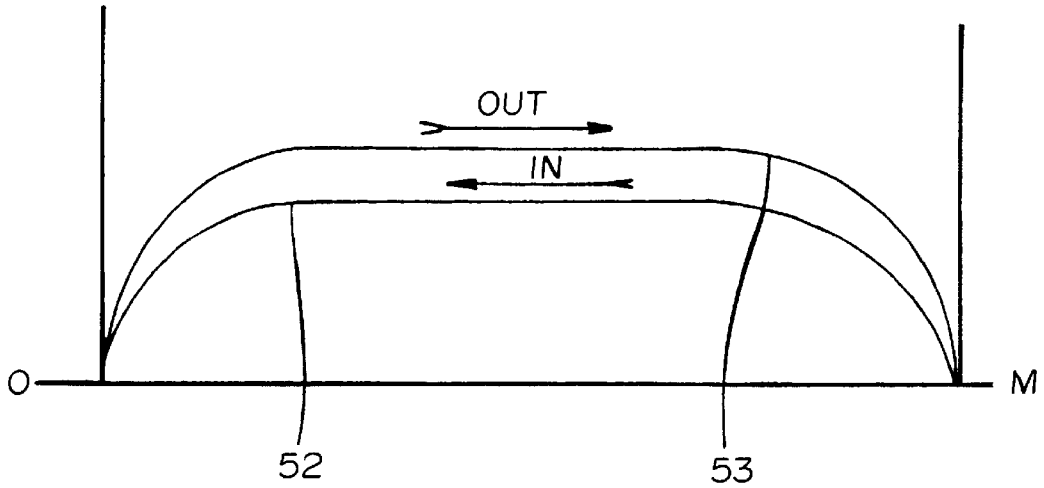
FIG. 9

TWO ARMS SYSTEM

There is a considerable call for a two-armed system for unit cranes, for instance. Such a crane consists of one rigid arm and thereafter an arm composed of a number of part-arms joined together, which can be influenced hydraulically in such a manner that the part-arms form a polygon. This arm is in turn attached to a stand or to said stand via a supporting arm. The two arms in the system, together with a supporting arm if used, can thus be arranged to be situated one above the other and also so that all the arms are extended. Various units can be attached at the tip of the rigid arm, for use in clearing trees and bushes, for instance. Units functioning as excavators or loaders can also be attached, or even a concrete pump or concrete hose. In existing systems with tow arms, the arm able to form a polygon is influenced by a hydraulic unit arranged between the arm parts so that, when the polygon is extended, the unit is located substantially in the middle of the polygon. Certain problems have been encountered when operating such two-armed systems, with regard to speed control of the tip of the rigid arm, and problems also occur with regard to the force exerted at said tip. Such a unit crane is suitably fitted on a caterpillar vehicle and this involves the problem of how to fold up the unit crane when it is not in operation. The arms will usually have a substantially vertical position, or they will be situated on the roof of the vehicle. There is also the problem of the actual joints of the unit arms being as stable as possible.

The object of the present invention is to solve the above-mentioned drawbacks and this is achieved, since both the arms in the system can be caused to lie one above the other, and possibly also above a supporting arm so that, when the arm system is not in use the free end of the arm with several parts is attached either to a stand or to one end of a supporting arm, the other end of which is journalled in the stand. When folded, therefore, the actual working tip or crane tip of the journalled package will be situated at the opposite part of the stand. To achieve suitable lifting power and suitable speed the crane tip is moved from a packaged position to the position it assumes when the tip is furthest away from the stand. The hydraulic mechanism influencing the arm with the many parts is arranged so that it influences two points situated outside two adjacent arm parts. Such a unit crane with its stand is suitably arranged on a platform provided with cab, in such a way that the arm system in the form of a package does not come into contact with the cab in any way. The vehicle carrying the crane package may be part of a centrally controlled vehicle in which the engine is jointed to the supporting part for the crane package. By arranging the hydraulic unit outside the arm with the many part-arms, the advantage is gained that the crane can be brought to a substantially horizontal position with the various arms arranged one after the other, and that it can be caused to assume a substantially downwardly-directed vertical position and upwardly-directed vertical position. The may joints in the arm system are subjected to considerable strain and it is therefore suitable for two arms to be combined so that one arm has two parallel shafts between which a stud located on the other arm is passed. The stud and the two arms together form a through-opening for a shaft journal. Each end of the shaft journal is provided with a tensioning ring having a conical surface and a tensioning cone, also having a conical surface, cooperating therewith. These two units with conical surfaces are brought into rigid contact with each other since the end cone is provided with a tightening bolt that can be screwed into each end of the shaft journal. Reliable functioning of the shaft journal located at a point about which the two arms can be oscillated is thus obtained.

Additional characteristics of the present invention are revealed in the appended claims.

Figure 2:
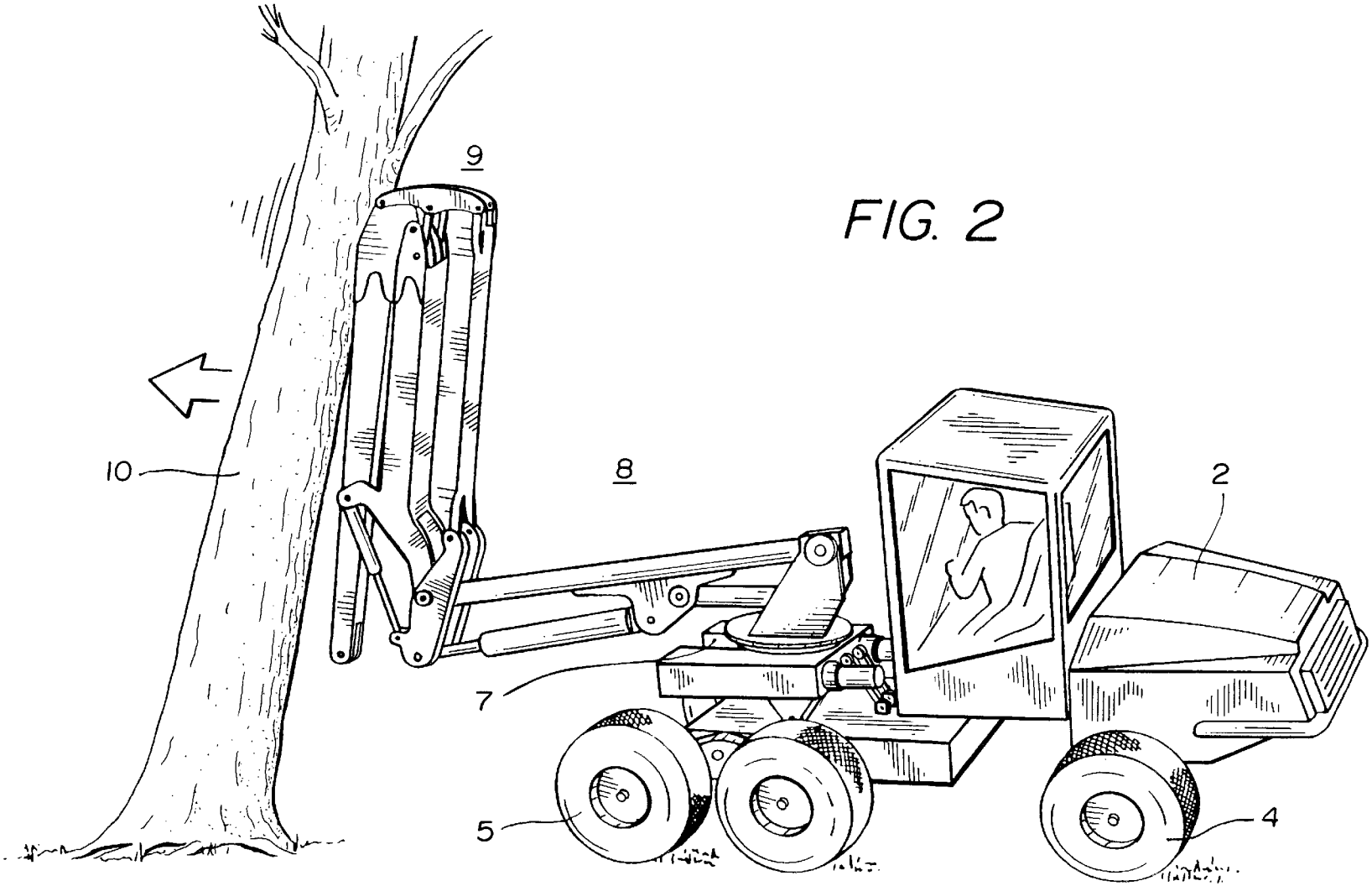
Figure 3:
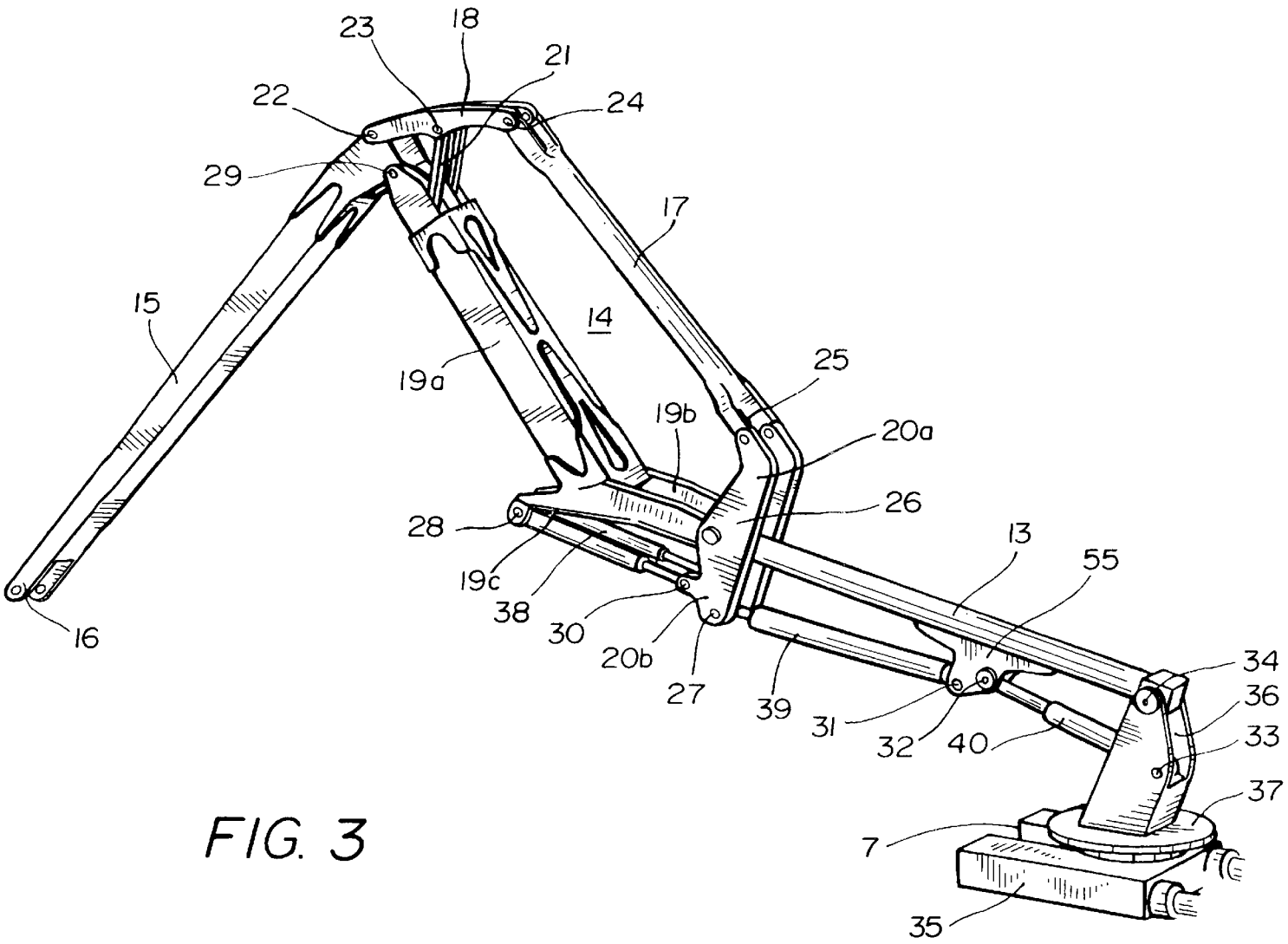
Figure 7:
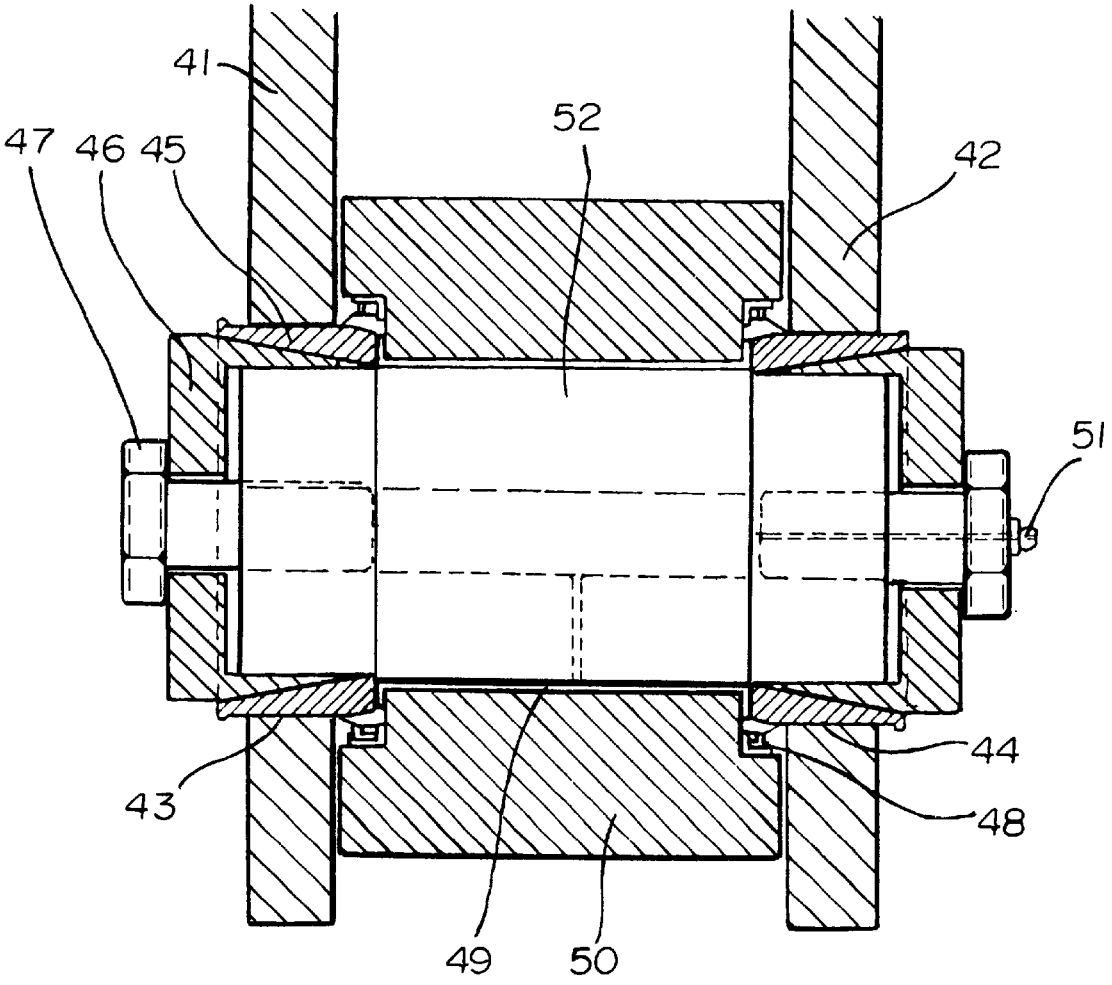

The present invention will now be described in more detail with reference to the accompany drawings in which FIG. 1 shows a centrally controlled vehicle with a crane package in rest position, the vehicle being on its way to a work place, FIG. 2 shows the vehicle at a work place where the unit crane is manipulating a tree, FIG. 3 shows a unit crane and stand in partially extended position, FIGS. 4–6 show various positions of a unit crane, FIG. 7 shows an arrangement for retaining shaft journals at a joint, FIG. 8 shows how the force in a crane tip varies between two possible positions of the crane tip, and FIG. 9 shows how the speed of the crane tip varies between its two outermost positions.

In FIG. 1, 1 designates a centrally controlled vehicle with a unit crane. The vehicle has an engine part arranged pivotably in relation to the support unit 3 for a crane unit. The engine part has a pair of front wheels and the support part 3 has bogie wheels 5. A cab 6 is arranged on the support part. This cab may be pivotable depending on which direction the vehicle is to be driven in. Naturally the cab may also be stationary and control means may be arranged in the cab so that the operator need only turn his seat 180°. A stand is arranged on the supporting unit, said stand being pivotably arranged by means of bearings 11, the movement of the stand being achieved with the aid of hydraulic cylinders 12. The complete crane package consisting of three-arms has been designated 8. Considering now the centrally controlled vehicle 1 in FIG. 2, this is shown in operation and it can be clearly seen that the arm package has a two-armed system 9 and also a supporting arm 13. The two-armed system is shown manipulating an object 10, which in the present case is a tree, and the operation shown comprises the vehicle with the crane package attempting to exert pressure on the tree.

FIG. 3 shows the crane package with stand in partially extended position. It can be seen that the inner arm 14 in the two-armed system is journalled at one end to a rigid arm 15 with a crane tip 16. The inner arm 14 is journalled at its inner end on a supporting arm 13 which is in turn journalled on the stand 7. The inner arm 14 consists of a first arm 17, a second arm 18, a third arm 19 and a fourth arm 20. All journalled points 22–34 joining the various parts of the arms together may be of the same type. One end of an arm part consists of two shaft parts and the connecting arm part consists of a studlike part which is placed between the two parts, the two parts and the stud part having holes that form a common opening for a shaft journal and this shaft journal is anchored in a special manner to be described in the following. The journalling points 22–34 thus constitute joint points for the units in the unit crane. The rear arm 14 in the crane has an arm 19*a* that is substantially solid and is provided at its end with two parallel arms having a part 19*b* that constitutes a part of the actual rear arm, whereas the part 19*c* is completely protruding. The fourth arm also consists of two parallel parts spaced from each other, and has a part 20*a* included in the rear arm 14 and a part 20*b* that protrudes outside the rear arm 14. Two intermediate arms are journalled at their free ends, between the middle of the second arm 18 and the upper end of the arm 19*a*. The lower end of the stand 7 comprises a plate, pivotable in relation to a substantially parallelepipedic part 35 which is turnable about a horizontal axis by means of hydraulic cylinders 12 shown in FIG. 1. Above the pivotable plate 37 the stand 7 is provided with two flanges 36. Between the two journalling points 28 and 30 are two hydraulic cylinders that influence the relative movement between the two arms in the two-armed system. At the middle of the supporting arm 13 is a flange arrangement with two journalling points 31 and 32. A hydraulic arrangement 39 is situated between the journalling points 27 and 31, and a hydraulic arrangement 40 is similarly arranged between the journalling points 32 and 33. The relative position between the two arms 14 and 15 in the two-armed system is controlled by the hydraulic arrangement 38. The two-armed system is in turn also influenced by the hydraulic cylinder arrangement 39 and the hydraulic cylinder arrangement 40 situated between the journalling points 32 and 33 controls the position of the supporting arm 13 which also has another influence, as already mentioned, namely that the position of the parallelepipedic unit 35 is influenced by the hydraulic arrangement 12.

FIGS. 4, 5 and 6 demonstrate how the three arms in the crane package can be brought to three extreme outermost positions. FIG. 4 shows a purely horizontal position, FIG. 5 directed vertically downwards and FIG. 6 directed vertically upwards.

FIG. 7 shows how two arm ends can be jointed together. In this case, one arm end must comprise two shafts or lugs 41 and 42 situated opposite each other and spaced apart. Each of the two shafts 41 and 42 is provided with a hole 43 and 44. A solid stud 50 arranged at the end of the arm to be connected is inserted between the two shafts. This stud or journal is provided with a through-opening 49. When the two arm ends are brought into engagement with each other, the openings 43, 44 and 49 will be aligned and a shaft journal 52 is inserted through them. A tensioning ring with an inner conical surface is applied at each end of the shaft journal and is placed in the holes 43 and 44. A tensioning cone 46 with a bottom and a cylindrical wall, conical on the outside, is applied at each end of the shaft journal 52. The conical surface of the tensioning cone 46 is brought into contact with the conical surface of the tensioning ring 45. In the bottom of the tensioning cone is an opening for a tightening bolt, threaded for engagement with an opening, also with threading, in the shaft journal. The two conical surfaces can thus be brought into firm contact with each other so that the shaft journal is immovable in the two outer holes 43 and 44. The shaft journal 52 may be provided with a grease cup 51 so that the bearing can be provided internally with lubricant. The bearing arrangement described can be used in all bearing arrangements in the unit crane or just in certain selected bearings, but it should be obvious that the bearing according to FIG. 7 is generally usable and may have applications entirely different from vehicles with unit cranes.

The crane tip in the unit crane has two outermost positions, one as shown in FIG. 1 and the other as shown in FIG. 4. Between these two extreme positions the curves in FIG. 8 have been taken up for forces operating on the crane tip, the curve 54 showing how the force varies from the inner position in FIG. 1 to the outer position in FIG. 4. Curve 55 also shows how the force varies during an inward movement. Curve 53 in FIG. 9, finally, shows the speed of the crane tip from the situation according to FIG. 1 to that according to FIG. 4 and curve 52 shows the equivalent speed during an inward movement. It is thus clear that the present invention has managed to produce a vehicle with a unit crane where, when not in use, the crane forms a convenient package, substantially horizontal, and is at a low level when the three arms are arranged one after the other, which is an advantage since the crane is then easy to service. It may then be suitable to bring the crane into the position shown in FIG. 4. Another advantage is that the crane will on no account come into contact with the driver's cab 6. No special vehicle is necessary as previously to transport the unit crane, and crane and vehicle provide an advantageous unit through the use of a centrally controlled vehicle.

It is clear that the speed and lifting capacity of the crane tip 16 vary depending on the hydraulic pressure used.

What is claimed is:

1. A two armed system for use in a unit crane comprising:

a base;

a first arm; and, a second arm connected to said first arm and said base, wherein said first arm and said second arm are shiftable between a first position where said first arm is positioned above said second arm and a second position where said first arm extends away from said second arm, said first arm being rigid and said second arm comprising a plurality of units jointedly connected to form a polygon, first point (28) on a first one (19*a*) of said units and a second point (30) on a second one (20*a*, 20*b*) of said units being movable relative to each other, said first unit (19*a*) having a first end and a second end and an arm (19*c*) extending outwardly from a location between said first and second ends, said first point being located on said first unit arm (19*c*), and said first unit (19*a*) being connected to said second unit (20*a*, 20*b*) at a point between a first end and a second end of said second unit, said second point being located at the second end of said second unit.

2. The system of claim 1 further comprising a hydraulic system (38) for moving said first point relative to said second point.

3. A two armed system for use in a unit crane comprising:

a base;

a first arm; and, a second arm connected to said first arm and said base, wherein said first arm and said second arm are shiftable between a first position where said first arm is positioned above said second arm and a second position where said first arm extends away from said second arm, said first arm being rigid and said second arm comprising a plurality of units jointedly connected to form a polygon, and one of said units (19*a*) of said second arm (20*a*, 20*b*) being flexibly connected to a support arm (13), said support arm (13) being flexibly connected to said base (7), said base being pivotable on a selectively tiltable platform (3).

4. The system of claim 3 wherein said support arm (13) is movable relative to said base (7).

5. The system of claim 3 wherein said second arm (20*2*, 20*b*) is movably vertically with respect to said support arm (13).

6. The system of claim 3 wherein said first arm and said second arm are shiftable between a first position wherein said first arm and said second arm are positioned above said support arm and a second position wherein said first arm and said second arm extend away from said support arm.

7. The system of claim 3 wherein said base is attached to a first part (3) of a vehicle (1) and wherein said vehicle includes a driver's cab (6) attached to said first part (3).

8. The system of claim 7 wherein said first part (3) includes bogie wheels (5).

9. The system of claim 7 wherein said driver's (6) can be turned depending on the direction of travel.

10. The system of claim 7 where said vehicle (1) includes an engine supported on a second part of said vehicle.

11. The system of claim 3 wherein said first arm has a distal end (16) and said distal end has a non-linear speed curve.

12. The system of claim 3 wherein said first arm has a distal end (16), said distal end being movable between a first point and a second point, wherein the force applied by said moving distal end follows a non-linear curve between said first and second points.

13. The system of claim 3 wherein said jointedly connected units include a conical recess and a conical journal.

14. A two-armed system as claimed in claim 3, characterized in that the flexibility between two arms (13 and 20) is achieved by the end of one of the arms (19*b*) being provided with two parallel, opposing shafts (41 and 42), each having a hole (43 and 44), said two holes (43 and 44) being situated immediately opposite each other and designed to accommodate one end of each of a shaft journal (52), and by the end of the second arm (13) being formed as preferably a stud (50) having two flat opposite surfaces, the distance between the surfaces corresponding to the distance between the opposing shafts (41 and 42), and where an opening (49) is arranged between the two surfaces, said opening (49) being intended to take said shaft journal (52).

15. A two-armed system as claimed in claim 14, characterized in that each end of the shaft journal (52) is provided with a tensioning ring (45) situated completely or partly in one of the holes (43 or 44, respectively) and whose conical surface cooperates with the conical surface in a tensioning cone (46) that can be screwed to each end of the shaft journal (52).

* * * * *